US011160707B2

(12) United States Patent
Gao

(10) Patent No.: US 11,160,707 B2
(45) Date of Patent: Nov. 2, 2021

(54) MULTIFUNCTIONAL MATTRESS OVERLAY

(71) Applicant: Caremed Supply Inc., New Taipei (TW)

(72) Inventor: Bing-Cheng Gao, New Taipei (TW)

(73) Assignee: Caremed Supply Inc., New Taipei (TW)

( * ) Notice: Subject to any disclaimer, the term of this patent is extended or adjusted under 35 U.S.C. 154(b) by 146 days.

(21) Appl. No.: 16/669,573

(22) Filed: Oct. 31, 2019

(65) Prior Publication Data

US 2021/0128383 A1 May 6, 2021

(51) Int. Cl.

| | |
|---|---|
| ***A61G 7/057*** | (2006.01) |
| ***A47C 27/10*** | (2006.01) |
| ***A61H 9/00*** | (2006.01) |
| ***A61G 7/00*** | (2006.01) |

(52) U.S. Cl.

CPC ..... *A61G 7/05776* (2013.01); *A47C 27/10* (2013.01); *A61G 7/001* (2013.01); *A61H 9/0078* (2013.01); *A61H 2201/0134* (2013.01); *A61H 2203/0443* (2013.01)

(58) Field of Classification Search

CPC .... A61G 7/05776; A61G 7/001; A47C 27/10; A61H 9/0078; A61H 2201/0134; A61H 2203/0443

USPC ..... 5/710

See application file for complete search history.

(56) References Cited

U.S. PATENT DOCUMENTS

| | | | | | |
|---|---|---|---|---|---|
| 4,272,856 | A * | 6/1981 | Wegener | A61G 1/00 | 180/116 |
| 4,517,690 | A * | 5/1985 | Wegener | A61G 1/00 | 180/125 |
| 5,251,349 | A * | 10/1993 | Thomas | A61G 7/001 | 5/713 |
| 5,267,364 | A * | 12/1993 | Volk | A61G 7/05776 | 5/710 |
| 5,685,036 | A * | 11/1997 | Kopfstein | A61G 7/05776 | 5/710 |
| 5,774,917 | A * | 7/1998 | Liu | A61G 7/001 | 5/609 |
| 5,956,787 | A * | 9/1999 | James | A61G 7/001 | 5/713 |
| 6,085,372 | A * | 7/2000 | James | A61G 7/001 | 5/713 |
| 6,240,584 | B1 * | 6/2001 | Perez | A47C 27/082 | 5/710 |
| 6,848,137 | B1 * | 2/2005 | Barnes | A47C 20/048 | 5/615 |

(Continued)

*Primary Examiner* — Myles A Throop

(57) ABSTRACT

A multifunctional mattress overlay of the present invention comprises an air cell body, a gas pipe set and an inflating device. The air cell body has multiple first and second air cells. The first and second air cells both have a left and right air chamber. The gas pipe set respectively connects to the left and right air chambers. The inflating device is connected to the gas pipe set, and can selectively inflate and/or deflate the left and right air chambers, which makes the air cell body show an alternate state. The inflating device can inflate and/or deflate all the right or all left air chambers separately, which makes the air cell body show a turnover state. Through it, the air cell body can selectively in the alternating state or the turnover state, which makes the air cell body massage the patient and also assist the patient in turning over.

4 Claims, 15 Drawing Sheets

(56) References Cited

U.S. PATENT DOCUMENTS

| | | | | |
|---|---|---|---|---|
| 7,171,711 | B2 * | 2/2007 | Gowda | A61G 7/05776 5/713 |
| 7,380,302 | B2 * | 6/2008 | Gilchrest, Jr. | A61G 7/0504 5/710 |
| 7,441,290 | B1 * | 10/2008 | Flick | A61G 7/05715 5/615 |
| 9,101,224 | B2 * | 8/2015 | Chiang | A47C 27/10 |
| 9,162,739 | B2 * | 10/2015 | Chew | B63B 35/36 |
| 9,259,098 | B2 * | 2/2016 | Williams | A47C 27/088 |
| 2004/0134133 | A1 * | 7/2004 | Busby | A47C 27/087 52/2.11 |
| 2006/0026767 | A1 * | 2/2006 | Chambers | A61G 7/0514 5/713 |
| 2006/0101580 | A1 * | 5/2006 | Biggie | A61G 7/05776 5/710 |
| 2007/0044240 | A1 * | 3/2007 | Chen Han | A61G 7/05776 5/655.3 |
| 2011/0296621 | A1 * | 12/2011 | McKenna | A61G 7/05776 5/671 |
| 2021/0145679 | A1 * | 5/2021 | Gao | A47C 27/082 |

* cited by examiner

MULTIFUNCTIONAL MATTRESS OVERLAY

FIELD OF THE INVENTION

The present invention relates to a mattress overlay holding a patient's body, and more particularly, to one capable of massaging the patient and assisting the patient in turning over from lying down.

BACKGROUND

Patients who are unable to move by themselves, such as sputum, vegetative, stroke, or spinal injury, often have to stay in bed for a long time because of limited mobility. However, when the patient is lying in bed for a long time, the patient will maintain the same posture for a long time because of unable to move by oneself, so that the local skin of the patient is pressed and cause blisters and broken skin. Even the local skin of the patient may have bedsores with tissue necrosis. However, in order to reduce the chance of bedsores in patients who are unable to move on their own, patients who are unable to move on their own will lie on a conventional mattress overlay for treatment and. Also, they are massaged and are turned over on the conventional mattress overlay to prevent necrosis of local skin.

Please refer to FIG. 1. The conventional mattress overlay 40 has a left-turn air cell 41 in the left side and a right-turn air cell 42 in the right side; a plurality of first massage air cells 43 and a plurality of second massage air cells 44 are arranged above the left-turn air cell 41 and the right-turn air cell 42; one second massage air cell 44 is between two first massage air cells 43. In the specific application of the mattress overlay 40, the first massage air cell 43 and the second massage air cells 44 are alternately inflated and deflated, so that the conventional mattress overlay 40 can massage the patient to promote blood circulation of the patient. Moreover, when the conventional mattress overlay 40 is to assist the patient in turning over, one of the left-turn air cell 41 and the right-turn air cell 42 is deflated, so that the patient can turn left or right while lying down to make the local skin of the patient not have necrosis. However, although the conventional mattress overlay 40 can reduce the chance of patients having bedsores, the structural design of the conventional mattress overlay 40 would increase the thickness of the conventional mattress overlay 40, which causes that the overall volume of the conventional mattress overlay 40 is too large to be easily stored.

SUMMARY

The main purpose of the present invention is to improve the structural configuration of both the air cell body and the gas pipe set, and the assembling form of the air cell body, the gas pipe set and the inflating device can not only allow the air cell body to continue to massage the patient, or assist the patient in turning over, but also effectively lower the thickness of the air cell body to reduce the overall volume of the air cell body.

The secondary purpose of the present invention is to improve the structural form of a mattress overlay, so that when the mattress overlay is inflated, the central area of the air cell bulges, and further when the patient lies on the mattress overlay, the central area of the mattress overlay will not be recessed too much because of the patient's weight, so that the patient can easily turn over while lying on the mattress overlay.

To achieve above purpose, the present invention relates to a multifunctional mattress overlay. The multifunctional mattress overlay comprises an air cell body, a gas pipe set and an inflating device. The air cell body comprises a plurality of first air cells arranged in a lateral direction, and a second air cell is disposed between the two first air cells. The first air cell and the second air cell both have a left air chamber and a right air chamber laterally arranged to the left air chamber. A partition is arranged between the left air chamber and the right air chamber, wherein the partition is configured to isolate the left air chamber from the right air chamber.

The gas pipe set comprises a first right gas pipe, a second right gas pipe, a first left gas pipe, and a second left gas pipe. The first right gas pipe is connected to the right chambers of all the first air cells, the second right gas pipe is connected to the right chambers of all the second air cells, the first left gas pipe is connected to the left chambers of all the first air cells, and the second left gas pipe is connected to the left chambers of all the second air cells.

The inflating device is connected to the gas pipe set and can alternately inflate as well as deflate the left and right chamber of the first air cell or the left and right chamber of the second air cell, such that the air cell body shows an alternate state; wherein the inflating device can inflate all the right air chambers or all the left air chambers separately, so that the air cell body is in a turnover state.

In the present embodiment, when the air cell body is in the alternate state, the left and right chambers of the first air cell show an inflated state of being filled with the gas, and simultaneously the left and right chambers of the second air cell show an deflated state of not being filled with the gas; when the air cell body is in the turnover state, one group of all the left or the right chambers are in the inflated state of being filled with the gas, while the other is in the deflated state of not being filled with the gas.

Wherein, the interior of the left air chamber and the interior of the right air chamber both are arranged with a deflector capable of guiding the gas to flow toward the upper end of the partition. The deflector has a head close to the upper end of the partition and a tail away from the lower end of the partition. The head is inclined toward the tail to form a flow guiding portion inclined with respect to the partition, so that the deflector can direct, the gas to flow toward the upper end of the partition.

In the present embodiment, the inclination direction of the deflector located inside the left air chamber is different from the deflector located inside the right air chamber, and the air cell body further has an elastic body. The elastic body is close to the lower end of the partition and is inclined with respect to the deflector, wherein the elastic body is located inside the left and right air chamber, and an auxiliary elastic body is arranged at the outer bottom of the air cell body, and the auxiliary elastic body is in contact with each the first and second air cell.

The present invention features a plurality of first air cells and second air cells, and the first air cells and second air cells are alternately arranged, such that one second air cell is disposed between the two first air cells. And both the first and second air cells have a left air chamber and a right air chamber. The left and right air chambers of the first air cell as well as the left and right air chambers of the second air cell each is connected to a gas pipe, wherein the inflating device, through the gas pipe, can selectively inflate or deflate the left and right air chambers of the first air cell, or inflate or deflate the left and right air chambers of the second air cell, such that the air cell body shows a alternate state to massage the patient. Besides, the inflating device also can separately inflate all the right or left air chambers via the gas pipe, allowing the air cell body to be in a turnover state to assist the patient in turning over. Through it, the structural form of mutually assembling among the air cell body, the gas pipe set and the inflating device not only can reduce the overall volume of the air cell body, but also can selectively bring the air cell body to the alternate state and the turnover state; so that in the case of reducing overall volume of the air cell body, the air cell body itself is capable of maintaining the function of massaging the patient or helping the patient turn over.

Besides, the first air cell and the second air cell both are arranged with a left air chamber and a right air chamber which are not connected to each other, and a partition of upright form disposed between the left and right air chambers. Each the left and right air chambers separately have a deflector to guide the gas to flow toward the upper end of the partition. Through it, when the left and right air chambers are inflated, the gas through the deflector will flow to the upper end of the partition, so that the central area of the air cell bulges upward, and then the central area of the mattress overlay, because of the collected gas and the partition, will not be recessed too much when the patient lies on the mattress overlay, which makes the patient easily turn over while lying on the mattress overlay.

DETAILED DESCRIPTION OF PREFERRED EMBODIMENTS

Figure 1:
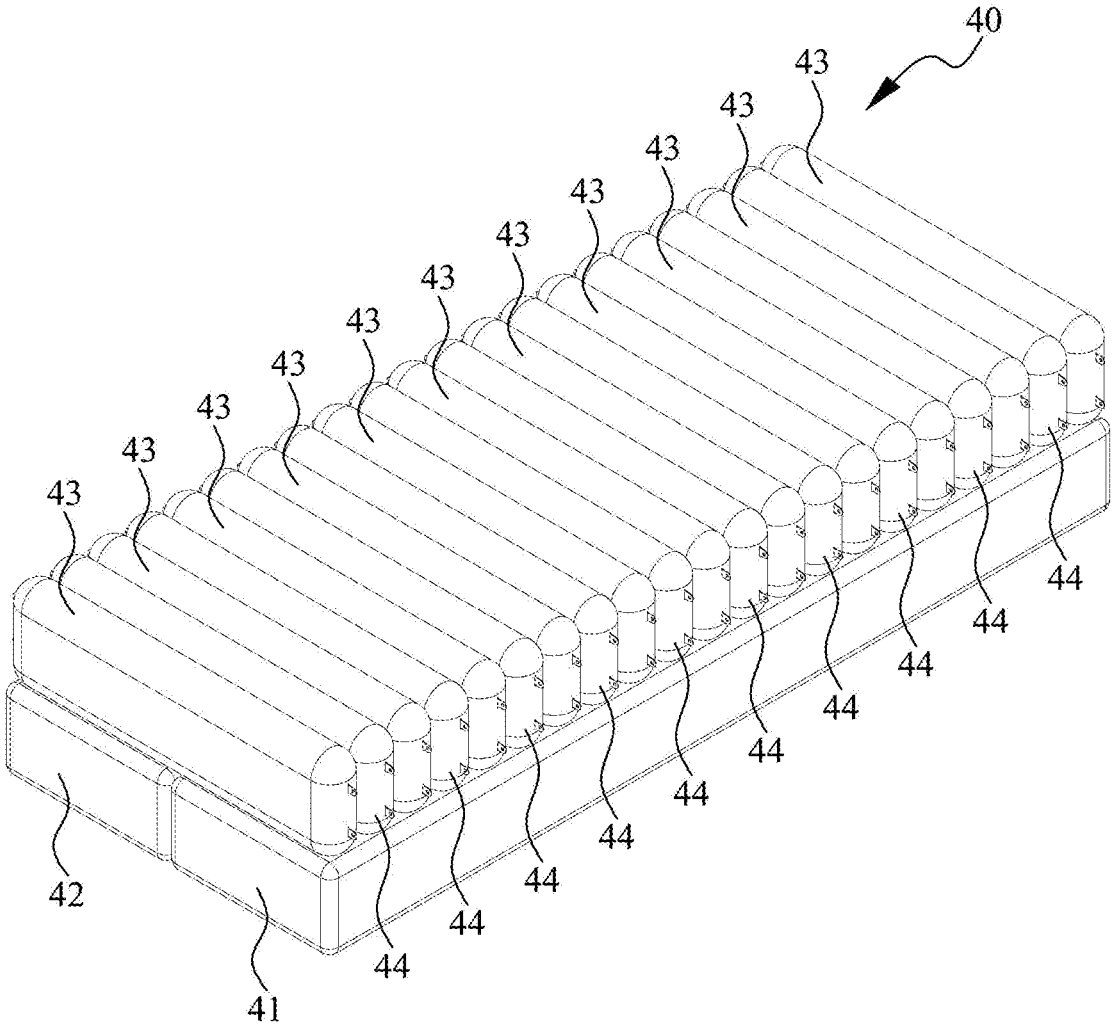
FIG. 1 (Prior Art)
FIG. 1 is a schematic illustrating a conventional mattress overlay.
Figure 2:
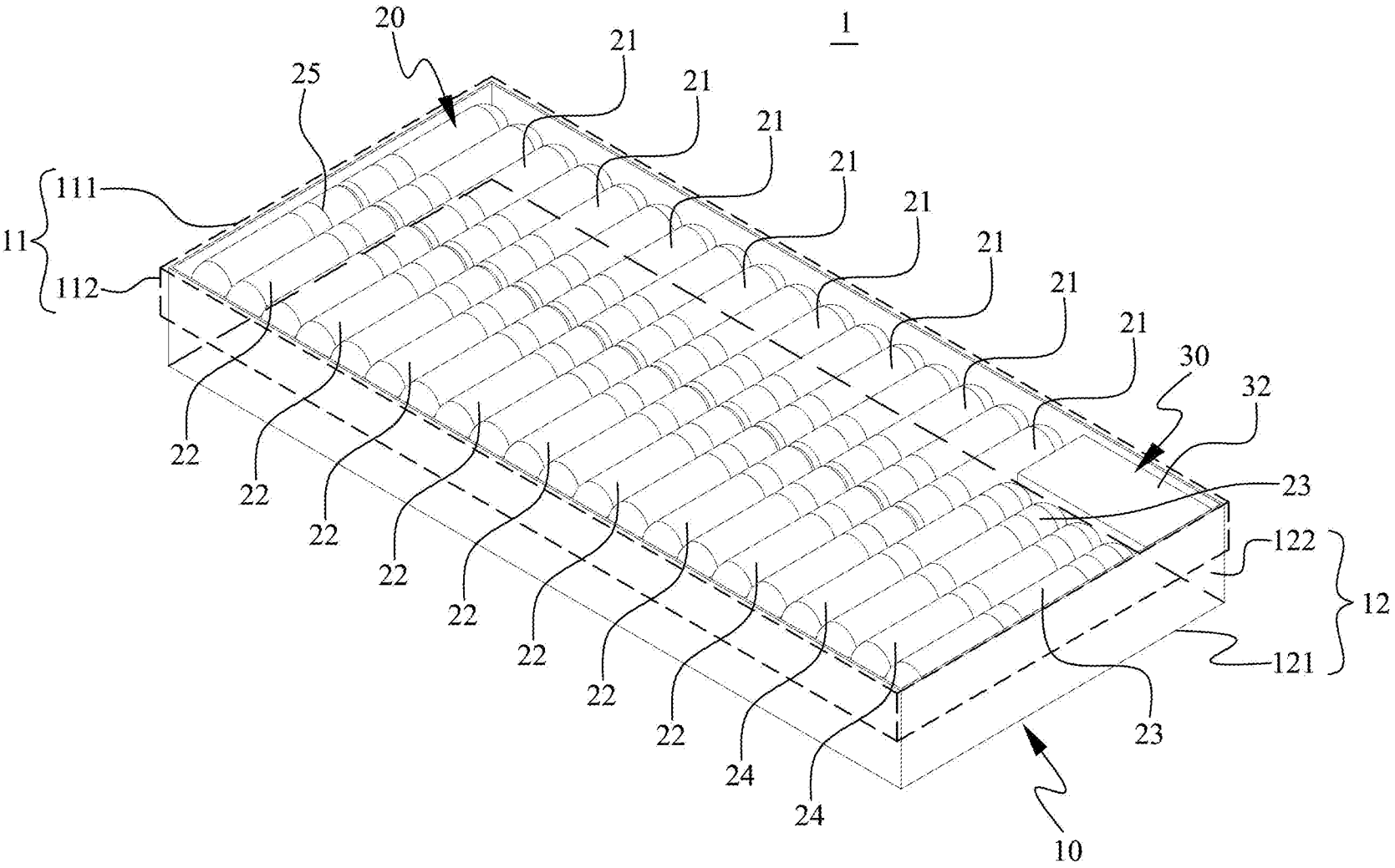
FIG. 2 is a schematic perspective view of the multifunctional mattress overlay according to the first embodiment.
Figure 3:
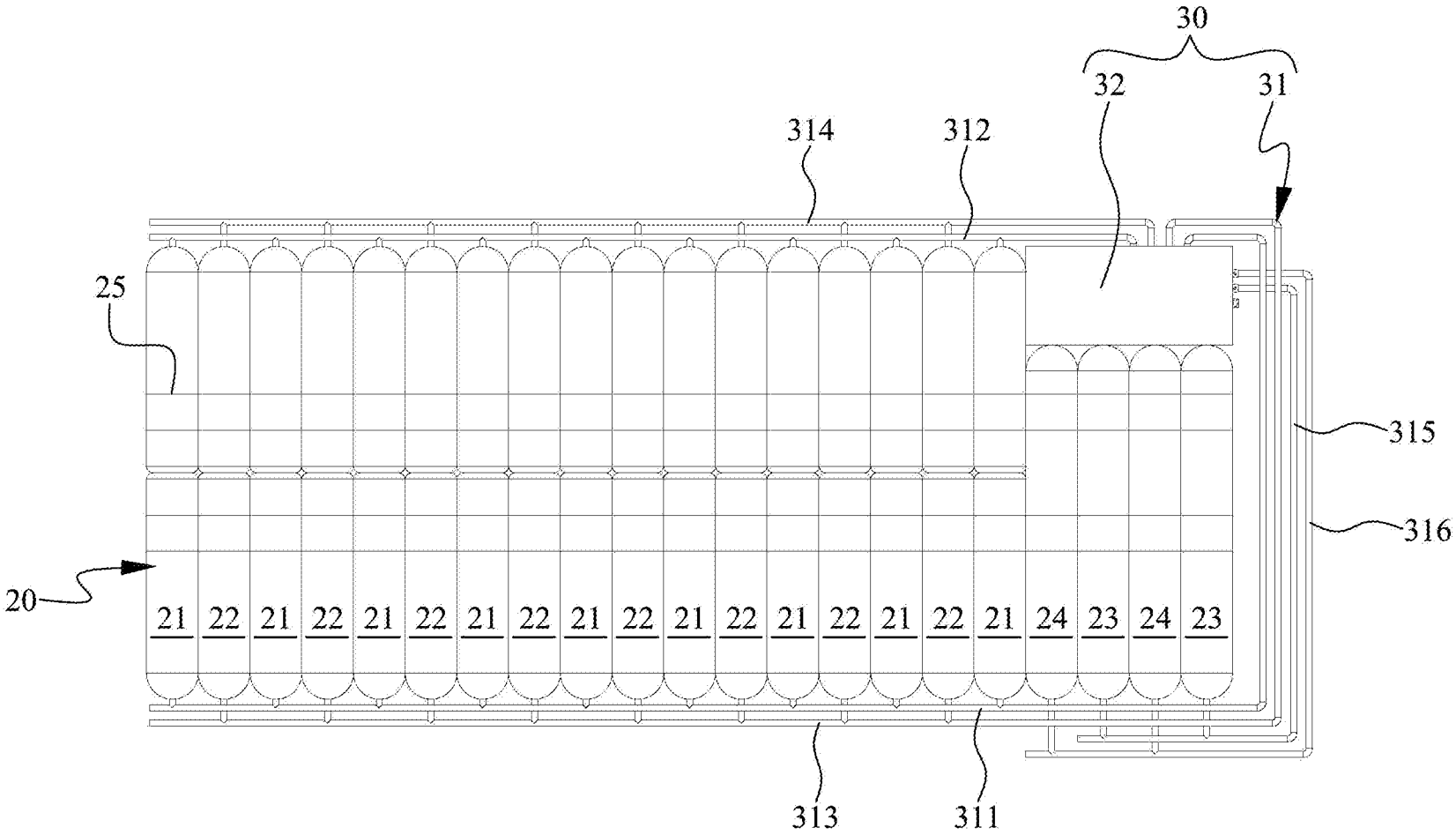
FIG. 3 is a schematic illustrating the air cell body assembled to the inflating device.
Figure 4:
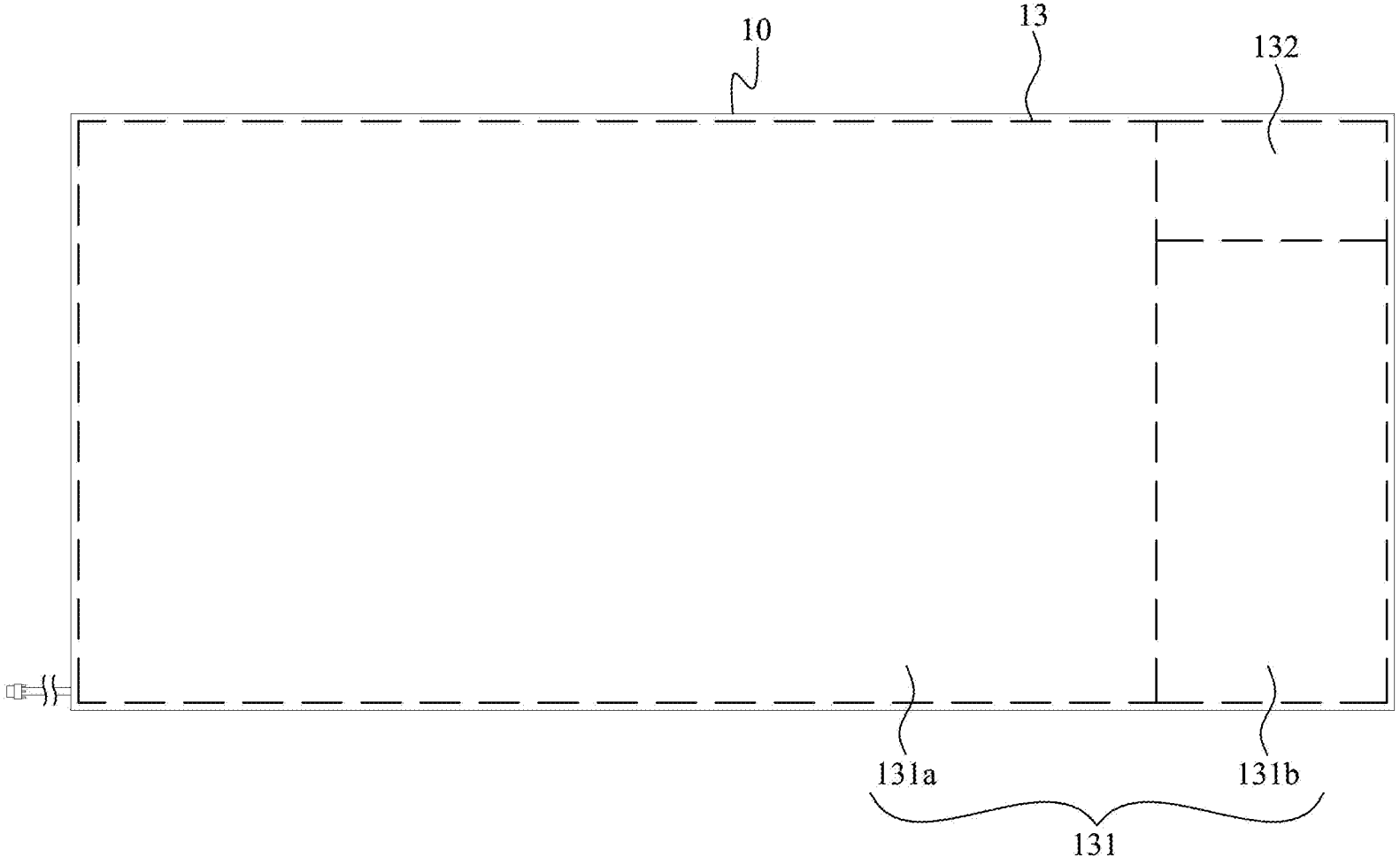
FIG. 4 is a schematic illustrating the accommodation space.

In order to further understand the structure, usage and features of the present invention more clearly and in detail, the present invention is described in detail below with references to the accompanying drawings and specific preferred embodiments:

Please refer to FIGS. 2 and 3. In first preferred embodiment, a multifunctional mattress overlay 1 in the present invention comprises a cover body 10, an air cell body 20 and an inflating device 30. The cover body 10 has an upper cover 11 and a lower cover 12 that is slightly smaller in size than the upper cover 11; the upper cover 11 comprises a top portion 111 of a rectangular form and an upper wall 112 extending from the outer periphery of the top portion 111 toward the lower cover 12; the lower cover 12 has a bottom portion 121 having a smaller size than the top portion 111 and a lower wall 122 extending from the outer periphery of the bottom portion 121 toward the top portion 111. In the present embodiment, The upper cover 11 can be selectively assembled to or separated from the lower cover 12 such that both the upper cover 11 and the lower cover 12 can be in an assembled state of being close to each other and in a separated state of being away from each other, wherein when the upper cover 11 and the lower cover 12 are in the assembled state, the upper wall 112 and the lower wall 122 are located between the top portion 111 and the bottom portion 121, and the lower wall 122 is simultaneously positioned at inner side of the upper wall portion 112, which makes the top portion 111, the upper wall 112, the bottom portion 121 and the lower wall 122 together form an accommodation space 13 inside the cover body 10 (as shown in FIG. 4). However, when the upper cover 11 and the lower cover 12 are in a separated state, both the air cell body 20 and the inflating device 30 are mounted inside the accommodation space 13.

Please refer to FIG. 4. Most area of the accommodation space 13 of the cover body 10 forms an air cell body accommodating area 131 and the remaining area of the accommodation space 13 forms an inflation accommodating area 132; wherein, a portion of the air cell body accommodating area 131 is configured as a first region 131*a* having a lateral width larger than the inflation accommodating area 132, and the remaining portion of the air cell body accommodating area 131 is configured as a second region 131*b* having a lateral width smaller than the first region 131*a*; wherein, the inflation accommodating area 132 is adjacent to the second region 131*b*. As shown in the figure, the inflated accommodating area 132 is adjacent to the two wall surfaces of the lower wall 122, so that the inflation accommodating area 132 is located at a corner of the accommodation space 13.

Figure 5:
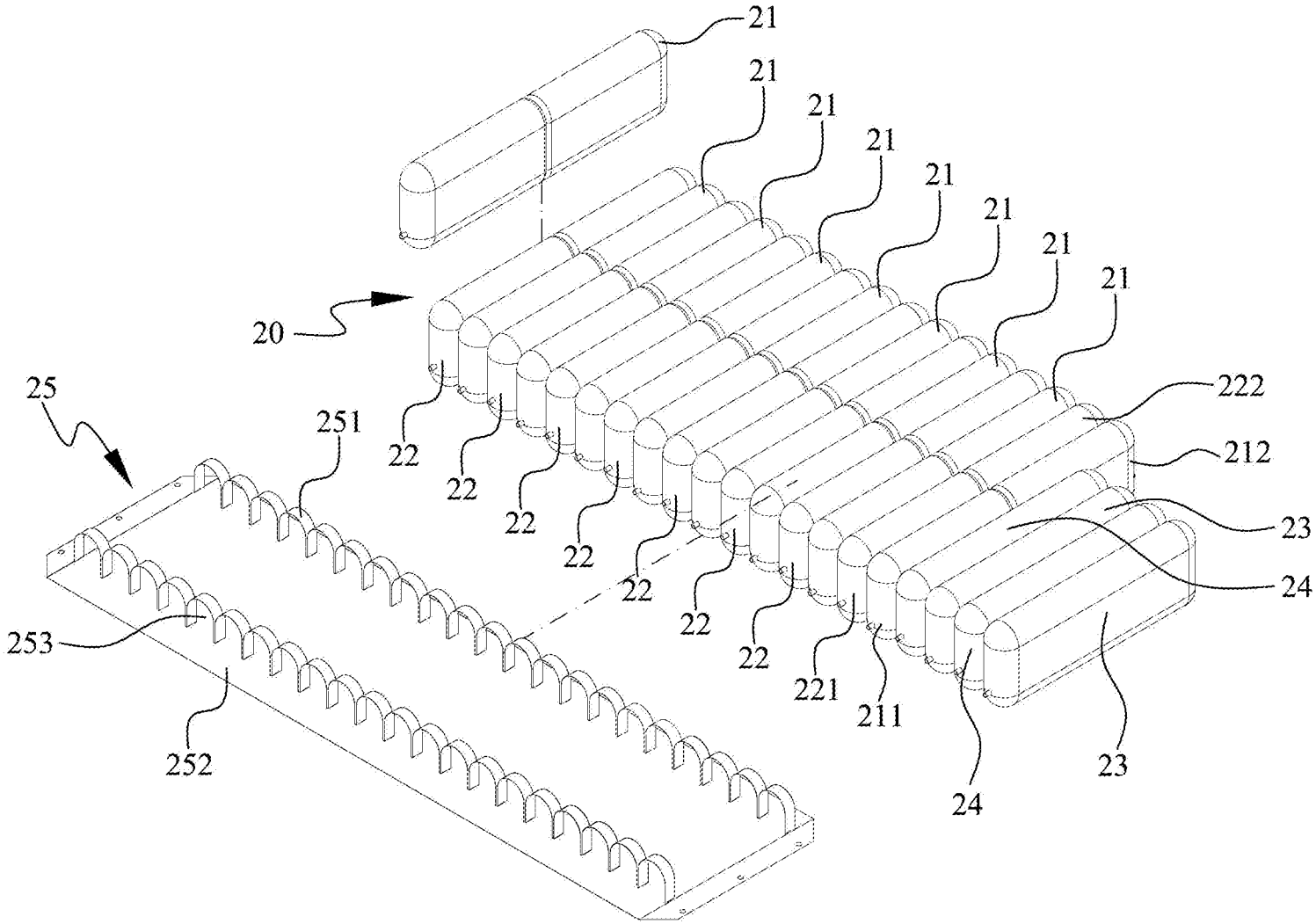
FIG. 5 is a schematic illustrating the air cell body assembled to the positioning unit.

Please refer to FIGS. 3 and 5. The air cell body 20 has a plurality of first air cells 21, a plurality of second air cells 22, a plurality of third air cells 23 and a plurality of fourth air cells 24; a plurality of first, second, third, and fourth air cells 21, 22, 23, 24 are arranged to each other through a positioning unit 25 in the accommodation space 13. As shown in the figure, the lateral length of the first air cell 21 is equal to the lateral length of the second air cell 22, and the lateral length of the third air cell 23 is equal to the lateral length of the fourth air cell 24, wherein the lateral length of the first air cell 21 is greater than the lateral length of the third air cell 23. In the present embodiment, All of the first air cells 21 and all of the second air cells 22 are located in the first region 131*a* of the air cell body accommodating area 131; the plurality of first, air cells 21 are laterally spaced apart in the first region 131*a*, and the each second air cell 22 are arranged between two first air cells 21 such that the plurality of first air cells 21 and the plurality of second air cells 22 are arranged alternately in a lateral direction. In addition, all of the third air cells 23 and all of the fourth air cells 24 are located in the second region 131*b* of the air cell body accommodating area 131, and the plurality of third air cells 23 and the plurality of fourth air cells 24 are alternately arranged in a lateral direction; such that the opposite sides of the third air cell 23 are separately arranged with the fourth air cell 24, and similarly the opposite sides of the fourth air cell 24 are separately arranged with the third air cell 23.

As shown in the figure, the positioning unit 25 has a plurality of positioning members 251 and a bottom board 252. The opposite ends of the positioning members 251 are all attached to the bottom board 252, so that a fitting passage 253 is formed between each the positioning member 251 and the bottom board 252. In the present embodiment, half quantity of the positioning members 251 are located in the right half of the bottom board 252, while the other half quantity of the positioning members 251 are located in the left half of the bottom board 252 and are symmetrically arranged to the positioning members 251 located in the right half of the bottom board 252. Wherein, each the first, second, third, and fourth air cell 21, 22, 23, 24 passes through both the fitting passage 253 located at the right half of the bottom board 252 and the fitting passage 253 located at the left half of the bottom board 252.

Figure 6:
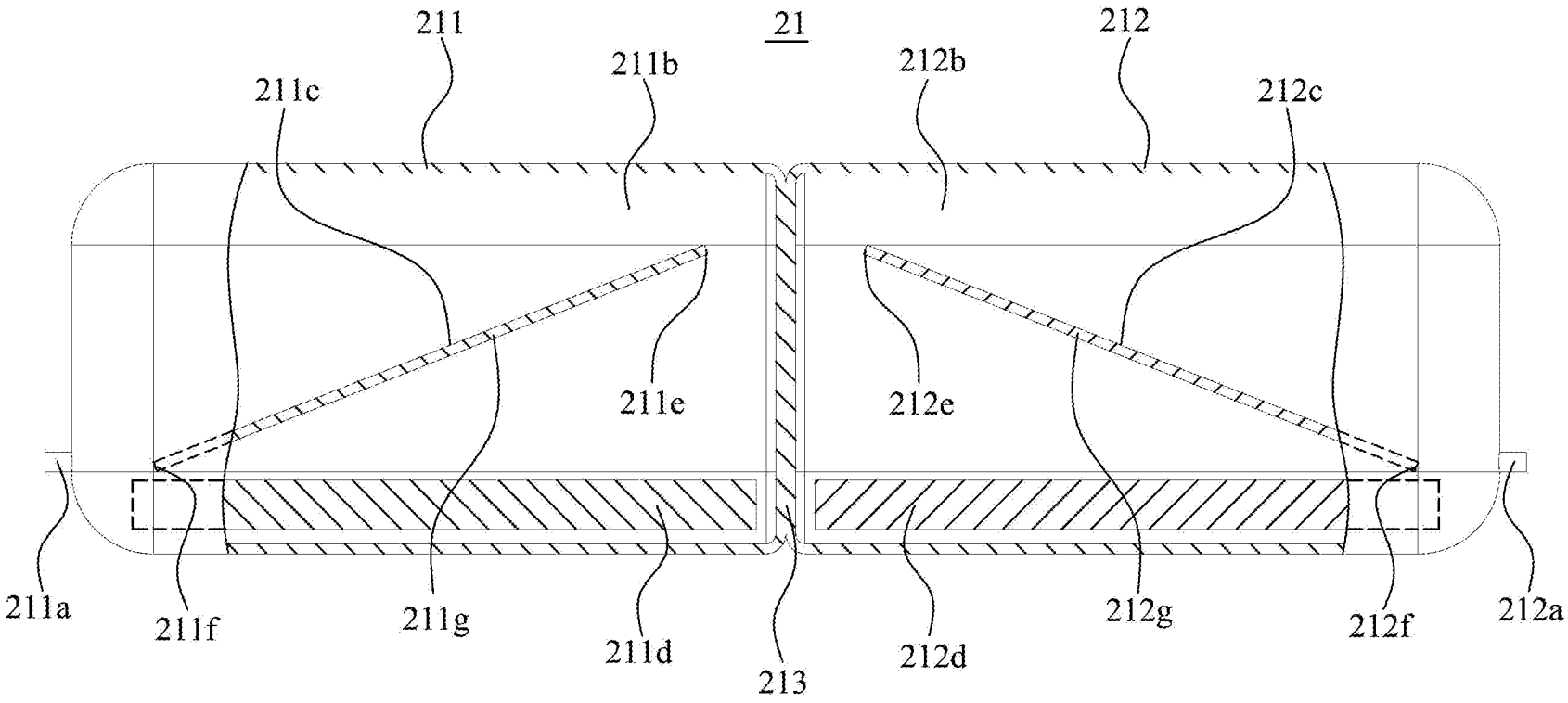
FIG. 6 is a schematic sectional view of the first air cell.

Please refer to FIG. 6. Each the first air cell 21 mainly has a first left inflating portion 211 and a first right inflating portion 212. The first left inflating portion 211 is laterally arranged to the first right inflating portion 212, so that a first partition 213 of upright form is formed between the first left inflating portion 211 and the first right inflating portion 212. As shown in FIG. 6, the exterior of the first left inflating portion 211 has a first left connector 211*a*, and the interior of the first left inflating portion 211 forms a first left air chamber 211*b* communicating with the first left connector 211*a*, wherein the first left air chamber 211*b* is located on one side of the first partition 213, and the interior of the first left air chamber 211*b* is arranged with a first left deflector 211*c* capable of guiding the gas to flow toward the upper end of the first partition 213 and a first left elastic body 211*d* inclined with respect to the first left deflector 211*c*. In the present embodiment, the first left deflector 211*c* has a left head 211*e* close to the upper end of the first partition 213 and a left tail 211*f* away from the lower end of the first partition 213, and the left head 211*e* is inclined toward the left tail 211*f* to form a left flow guiding portion 211*g* inclined with respect to the first partition 213. Besides, the exterior of the first right inflating portion 212 has a first right connector 212*a* away from the first left connector 211*a*, and the first right connector 212*a* communicates with a first right air chamber 212*b* formed inside the first right inflating portion 212. Wherein, the first right air chamber 212*b* is located on the other opposite side of the first partition 213 such that the first partition 213 is located between the first left air chamber 211*b* and the first right air chamber 212*b*, whereby the first partition 213 can be used to isolate the first left air chamber 211*b* from the first right air chamber 212*b*. As shown in the figure, inside of the first right air chamber 212*b* is arranged with a first right deflector 212*c* that functions as the first left deflector 211*c* and a first right elastic body 212*d* that is inclined with respect to the first right deflector 212*c*. In the present embodiment, the opposite ends of the first right deflector 212*c* are respectively configured as a right head 212*e* and a right tail 212*f*; the right head 212*e* of the first right deflector 212*c* is close to the upper end of the first partition 213, and The right tail 212*f* of the first right deflector 212*c* is away from the lower end of the first partition 213; wherein, the right head 212*e* is inclined toward the right tail 212*f* to form a right flow guiding portion 212*g* having a different inclination direction from the left flow guiding portion 211*g*, and the right flow guiding portion 212*g*, like the left flow guiding portion 211*g*, is also inclined with respect to the first partition 213.

Figure 7:
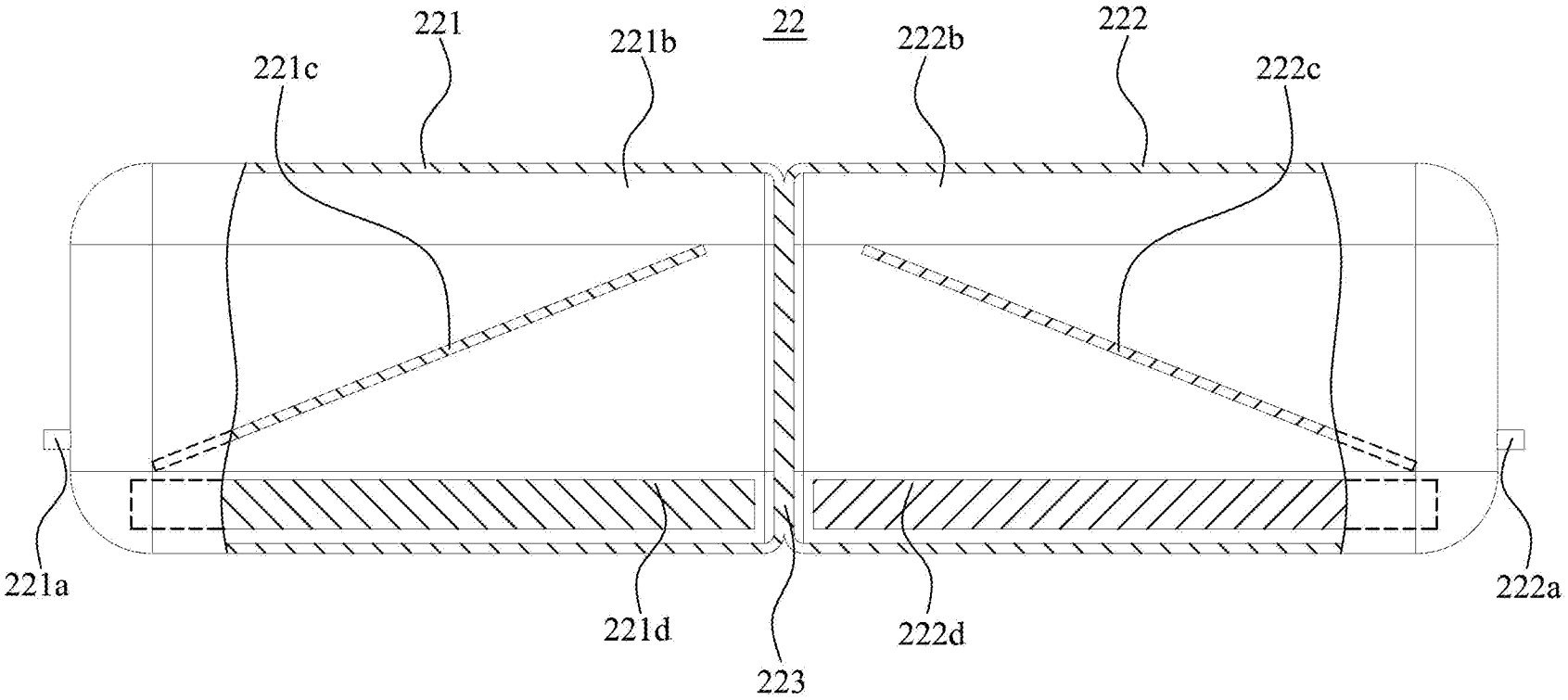
FIG. 7 is a schematic sectional view of the second air cell.

Please refer to FIG. 7. Each the second air cell 22 has a second left inflating portion 221 and a second right inflating portion 222 laterally arranged to the second left inflating portion 221, which makes a second partition 223 of upright form between the first left inflating portion 211 and the first right inflating portion 212. As shown in FIG. 7, the exterior of the second left inflating portion 221 and the second right inflating portion 222 are separately arranged with a second left connector 221*a* and a second right connector 222*a*; the interior of the second left inflating portion 221 forms a second left air chamber 221*b* communicating with the second left connector 221*a* and the second right connector 222*a* communicates with a second right air chamber 222*b* formed inside the second right inflating portion 222; wherein, the interior of the second left air chamber 221*b* has a second left deflector 221*c* having the same structure as the first left deflector 211*c* and a second left elastic body 221*d* inclined with respect to the second left deflector 221*c*; the interior of the second right air chamber 222*b* has a second right deflector 222*c* having the same structure as the first right deflector 212*c* and a second right elastic body 222*d* inclined with respect to the second right deflector 222*c*. In the present embodiment, the second partition 223 can isolate the second left air chamber 221*b* from the second right air chamber 222*b*; the second left and right deflectors 221*c*, 222*c* respectively have the same structure as the first left and right deflectors 211*c*, 212*c*, so that the second left and right deflectors 221*c*, 222*c* both can direct the gas to flow toward the upper end of the second partition 223.

Figure 8:
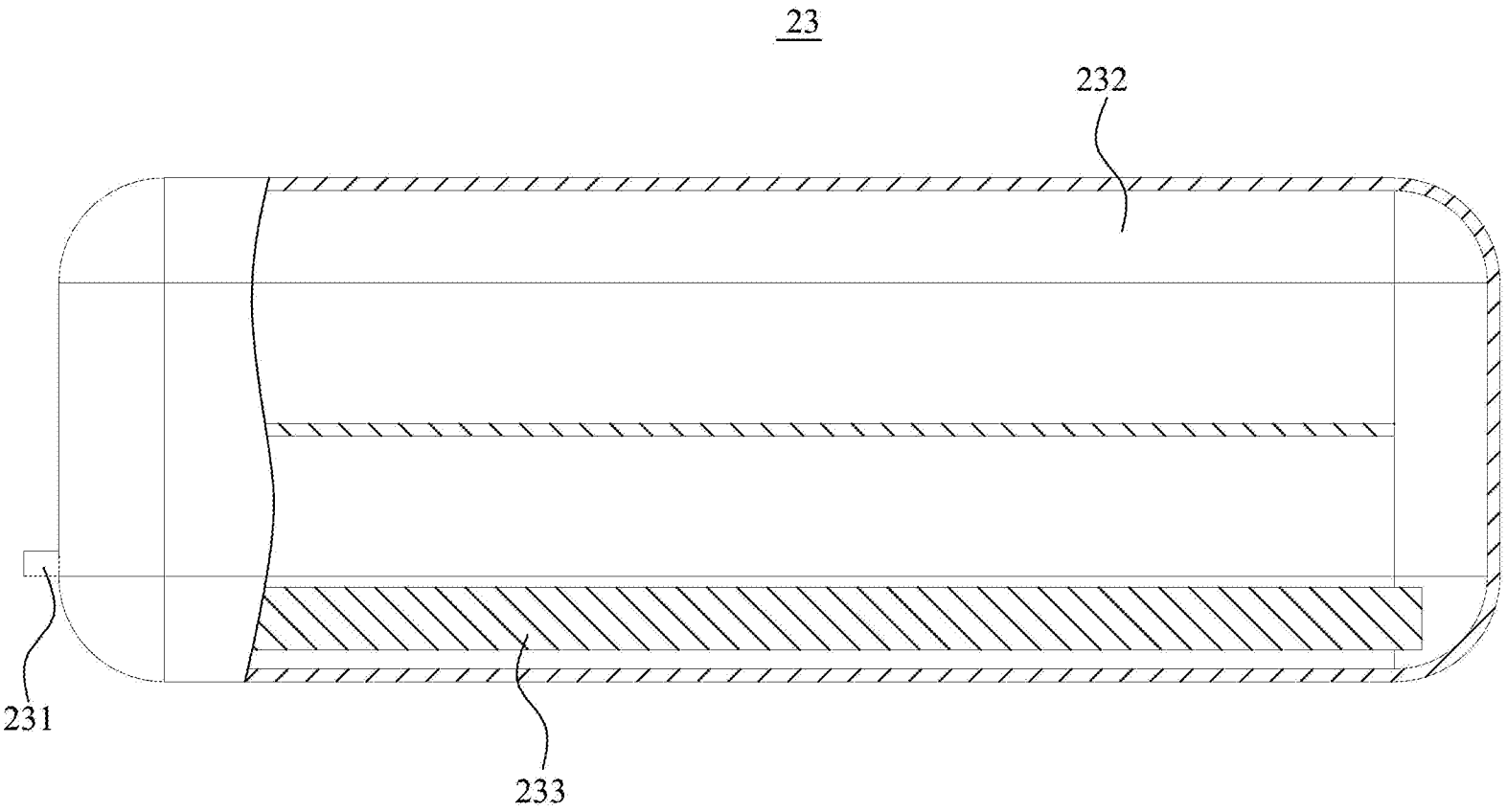
FIG. 8 is a schematic sectional view of the third air cell.
Figure 9:
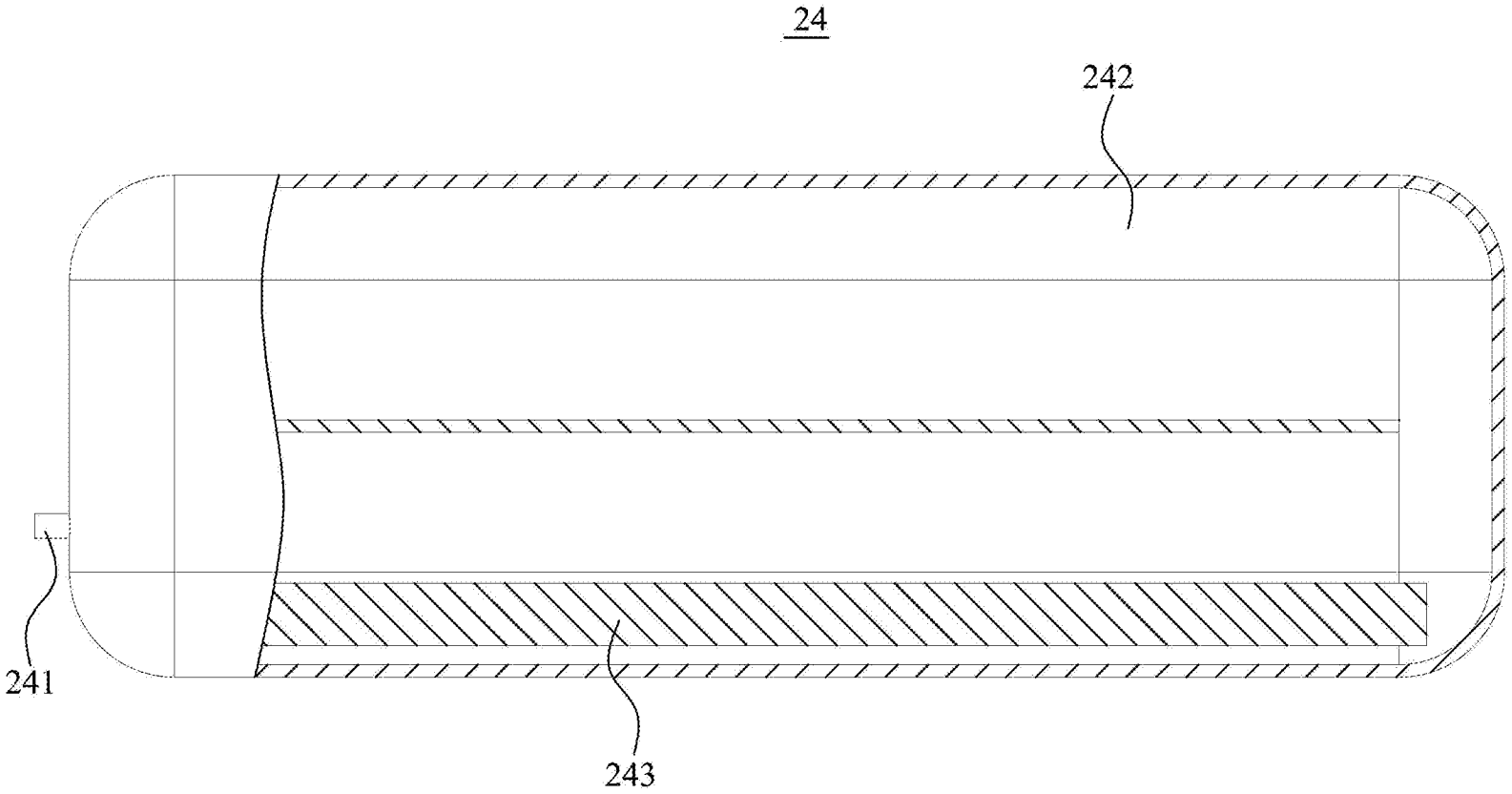
FIG. 9 is a schematic sectional view of the fourth air cell.

Please refer to FIG. 8. A third connector 231 is disposed outside each the third air cell 23, and a third air chamber 232 communicating with the third connector 231 is formed inside each the third air cell 23, and a third elastic body 233 capable of deforming is formed inside the third air chamber 232. Pease refer to FIG. 9. Each the fourth air cell 24 has the same structure as the third air cell 23, so that the fourth air cell 24 is provided with a fourth connector 241 having the same function as the third connector 231, a fourth air chamber 242 having the same function as the third air chamber 232, and a fourth elastic body 243 having the same function as the third elastic body 233.

Please refer to FIG. 3. The inflating device 30 has a gas pipe set 31 and an inflating device 32. The gas pipe set 31 is located inside the accommodating space 13 and has a first left gas pipe 311, a first right gas pipe 312, a second left gas pipe 312, a second right gas pipe 314, a third gas pipe 315 and a fourth gas pipe 316. The first left gas pipe 311 is connected to the first left connectors 211*a* of all the first air cells 21 such that the first left gas pipe 311 is connected to the first left air chamber 211*b* of the first air cell 21 through the first left connector 211*a*; while the first right gas pipe 312 is connected to the first right connectors 212*a* of all the first air cells 21 such that the first right gas pipe 312 communicates with the first right air chamber 212*b* of the first air cell 21 through the first right connector 212*a*.

Wherein, the second left gas pipe 313 is connected to the second left connectors 221*a* of all the second air cells 22, so that the second left gas pipe 313 communicates with the second left air chamber 221*b* of the second air cell 22 through the second left connector 221*a*. Additionally, the second right gas pipe 314 is connected to the second right connectors 222*a* of all the second air cells 22 such that the second right gas pipe 314 communicates with the second right air chamber 222*b* of the second air cell 22 through the second right connector 222*a*.

As shown in the figure, both the third gas pipe 315 and the fourth gas pipe 316 are located in the second region 131*b* of the air cell body accommodating area 131, wherein the third gas pipe 315 communicates with the third connectors 231 of all the third air cells 23 so that the third gas pipe 315 communicates with the third air chamber 232 of the third air cell 23 through the third connector 231; the fourth gas pipe 316 communicates with the fourth connectors 241 of all the fourth air cells 24, so that the fourth gas pipe 316 communicates with the fourth air chamber 242 of the fourth air cell 24 through the fourth connector 241; besides, the inflating device 32 is located in the inflation accommodating area 132 of the accommodation space 13 and can supply gas; the inflating device 32 is connected to the gas pipe set 31, and can supply the gas to the first left gas pipe 311, the first right gas pipe 312, the second left gas pipe 313, the second right gas pipe 314, the third gas pipe 315, and the fourth gas pipe 316.

Figure 10A:
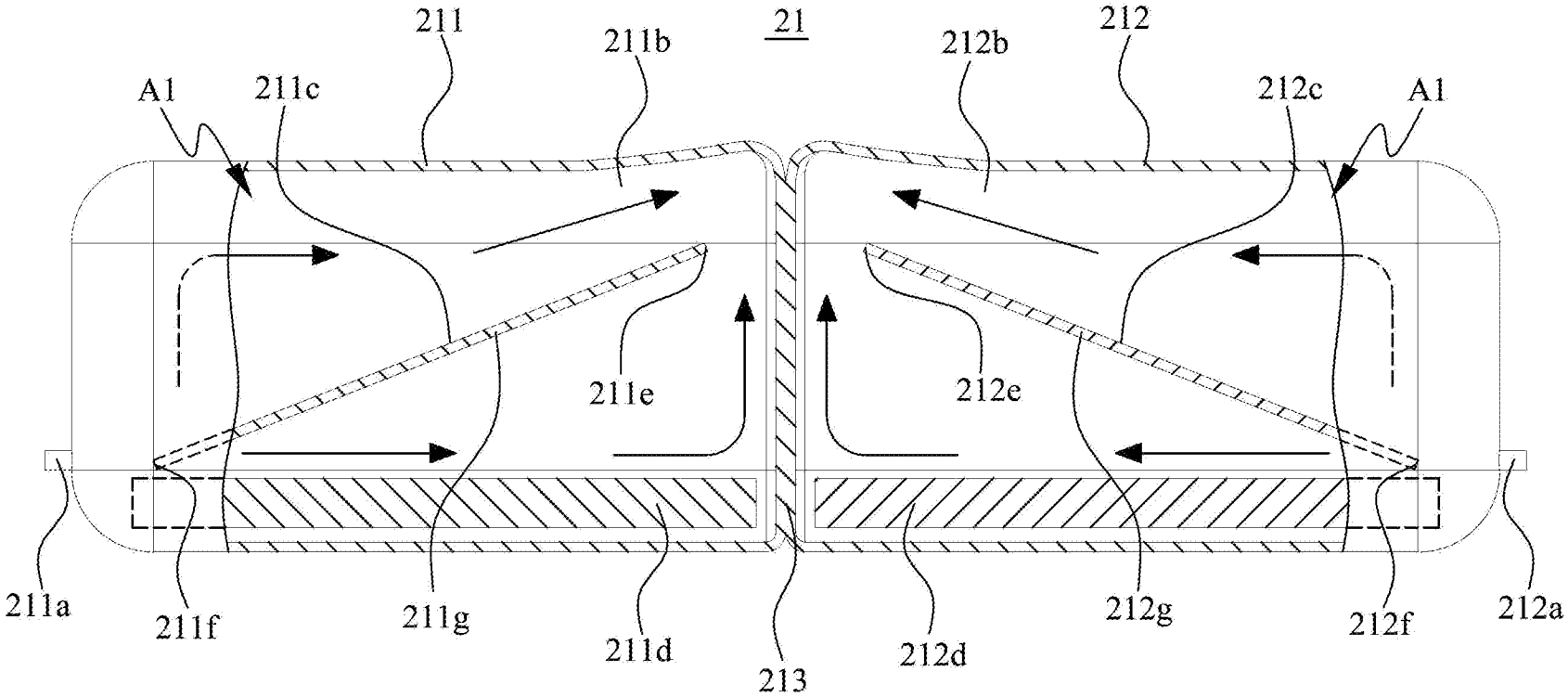
FIG. 10A is a schematic illustrating inflation for the first and second air cells.
Figure 10B:
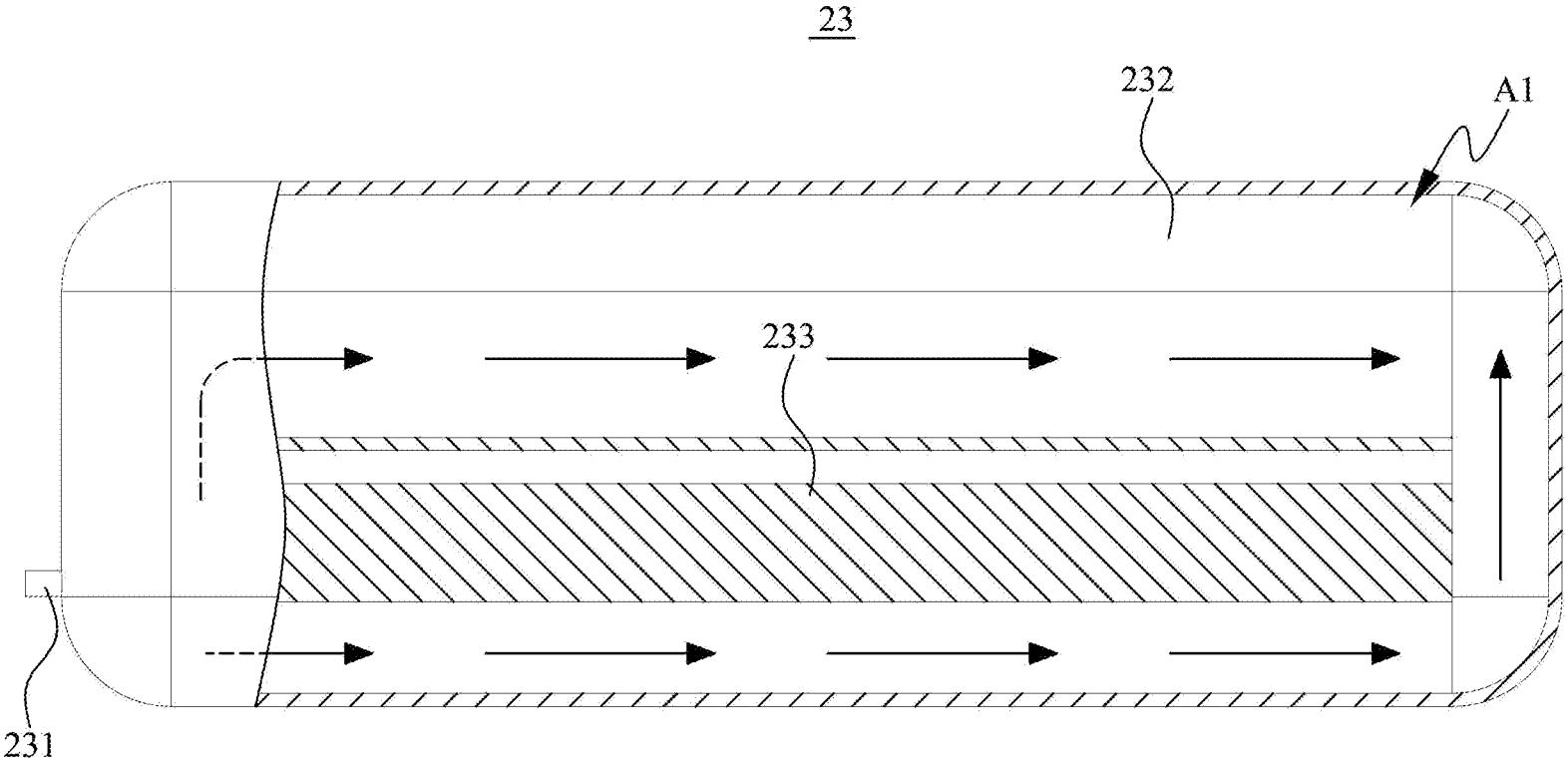
FIG. 10B is a schematic illustrating inflation for the third and fourth air cells.

Please refer to FIGS. 10A and 10B. The inflating device 32 of the inflating device 30 generates gas and supplies the gas to the gas pipe set 31 of the inflating device 30, so that the gas can flow into the interior of the air cell body 20. As shown in the FIG. 10A, the inflating device 32 supplies the gas to the first left gas pipe 311 of the gas pipe set 31 and the first right gas pipe 312 of the gas pipe set 31, so that the gas, through the first left connector 211*a* and the first right connector 212*a*, respectively flows into the first left air chamber 211*b* of the first air cell 21 and the first right air chamber 212*b* of the first air cell 21; thus the interior of the first left and right air chambers 211*b*, 212*b* are filled with the gas and both show an inflated state A1. Similarly, the inflating device 32 supplies the gas to the second left gas pipe 313 of the gas pipe set 31 and the second right gas pipe 314 of the gas pipe set 31, so that the gas, through the second left connector 221*a* and the second right connector 222*a*, respectively flows into the second left air chamber 221*b* of the second air cell 22 and the second right air chamber 222*b* of the second air cell 22; thus the interior of the second left and right air chambers 221*b*, 222*b* are filled with the gas and also show an inflated state A1. As shown in FIG. 10B, the inflating device 32 makes the gas transported to the third air chamber 232 of the third air cell 23 through the third air pipe 315 of the air pipe set 31 and the third connector 231 of the third air cell 23, so that the third air chamber 232 can be in the inflated state A1; similarly, the inflating device 32 makes the gas transported to the fourth air chamber 242 of the fourth air cell 24 through the fourth air pipe 316 of the air pipe set 31 and the fourth connector 241 of the fourth air cell 24, so that the fourth air chamber 242 can be in the inflated state A1 as the third air chamber 232.

Wherein, when the inflating device 32 of the inflating device 30 inflates the first left and right air chambers 211*b*, 212*b* of the first air cell 21, the gas through the first left and right deflector 211*c*, 212*c* flows toward the upper end of the first partition 213, such that the central area of all the first cells 21 bulges upward. Besides, when the inflating device 32 of the inflating device 30 inflates the second left and right air chambers 221*b*, 222*b* of the second air cell 21, the gas through the second left and right deflector 211*c*, 212*c* flows toward the upper end of the second partition 223, such that the central area of all the second cells 22 also, like the first cells 21, bulges upward. Accordingly, when the patient lies on the multifunctional mattress overlay 1, the central area of the multifunctional mattress overlay 1 would not be recessed too much through the collected gas as well as the first and second partitions 213, 223, so that the patient can easily turn over while lying on multifunctional mattress overlay 1.

Figure 11A:
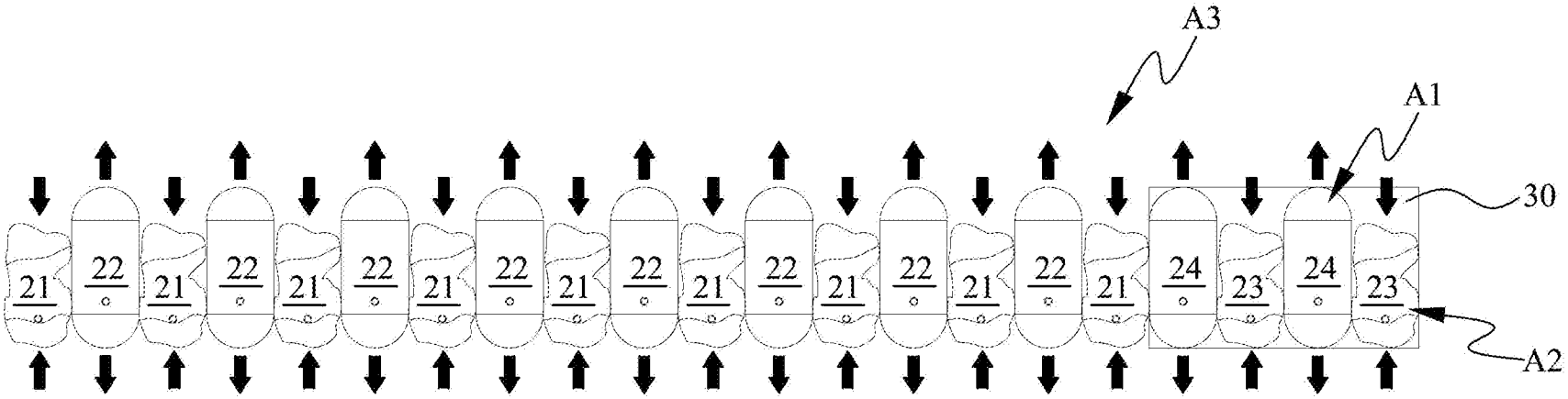
FIG. 11A is a schematic illustrating the first left, the first right and third air cells in the deflated state.
Figure 11B:
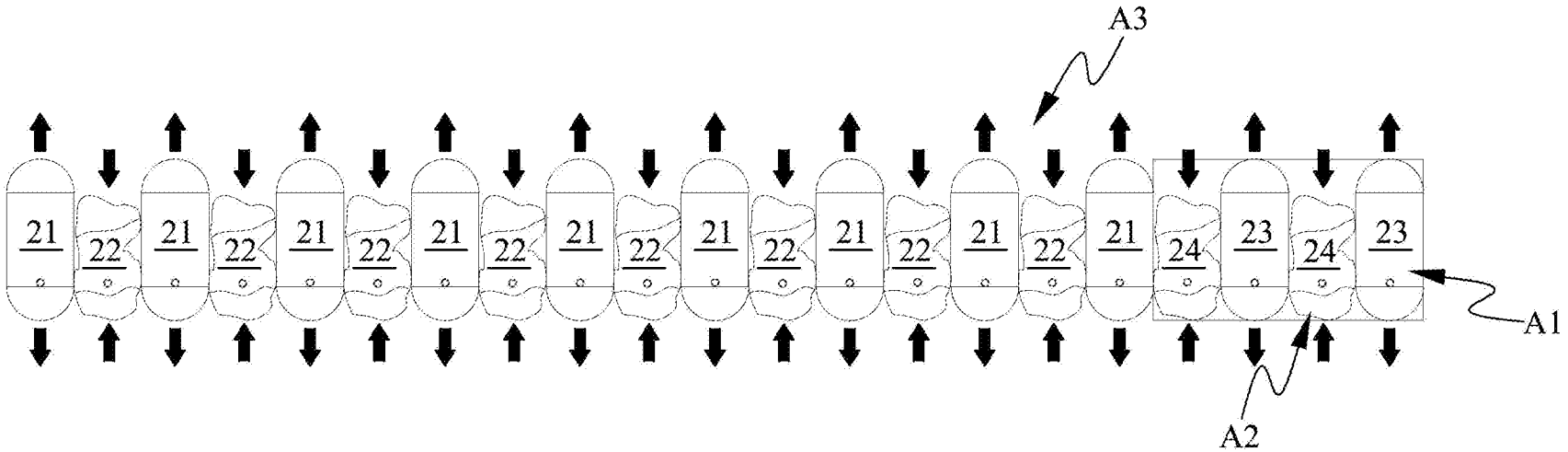
FIG. 11B is a schematic illustrating the second left, the second right and fourth air cells in the deflated state.

Please refer to FIGS. 11A and 11B. When the air cell body 20 is intended to massage the patient, the inflating device 30 first deflates the first left and right air chambers 211*b*, 212*b* of the first air cell 21, such that the first left and right air chambers 211*b*, 212*b* are changed from the inflated state A1 to be in a deflated state A2 of being unfilled with gas; at the same time, the inflating device 30 also deflates the third air chamber 232 of the third air cell 23, which makes the third air chamber 232 also changed to be in the deflated state A2. When the first left air chamber 211*b*, the first right air chamber 212*b* and the third air chamber 232 are in the deflated state A2, the inflating device 32 starts to inflate the first left air chamber 211*b*, the first right air chamber 212*b* and the third air chamber 232, which makes the first left air chamber 211*b*, the first right air chamber 212*b* and the third air chamber 232 changed to be in the inflated state A1 from the deflated state A2; at the same time, the inflating device 32 deflates the second left air chamber 221*b*, the second right air chamber 222*b* and the fourth air cell 24, which makes the second left air chamber 221*b*, the second right air chamber 222*b* and the fourth air cell 24 changed to be in the deflated state A2 from the inflated state A1. Subsequently, when the first left air chamber 211*b*, the first right air chamber 212*b* and the third air chamber 232 are in the inflated state A1, the inflating device 32 deflates the first left air chamber 211*b*, the first right air chamber 212*b* and the third air chamber 232, and simultaneously inflates the second left air chamber 221*b*, the second right air chamber 222*b* and the fourth air cell 24; accordingly, the first left air chamber 211*b*, the first right air chamber 212*b* and the third air chamber 232 are in the deflated state A2, while the second left air chamber 221*b*, the second right air chamber 222*b* and the fourth air cell 24 are in the inflated state A1; whereby, the inflating device 32 can alternately inflate and deflate the first, second, third and fourth air cells 21, 22, 23, 24; such that the first left air chamber 211*b*, the first right air chamber 222*b*, the second left air chamber 221*b*, the second right air chamber 222*b*, the third air chamber 232 and the fourth air chamber 232 can selectively be in the inflated state A1 or in the deflated state A2, which makes the air cell body 20 have an alternate state A3 to massage the patient.

Figure 12A:
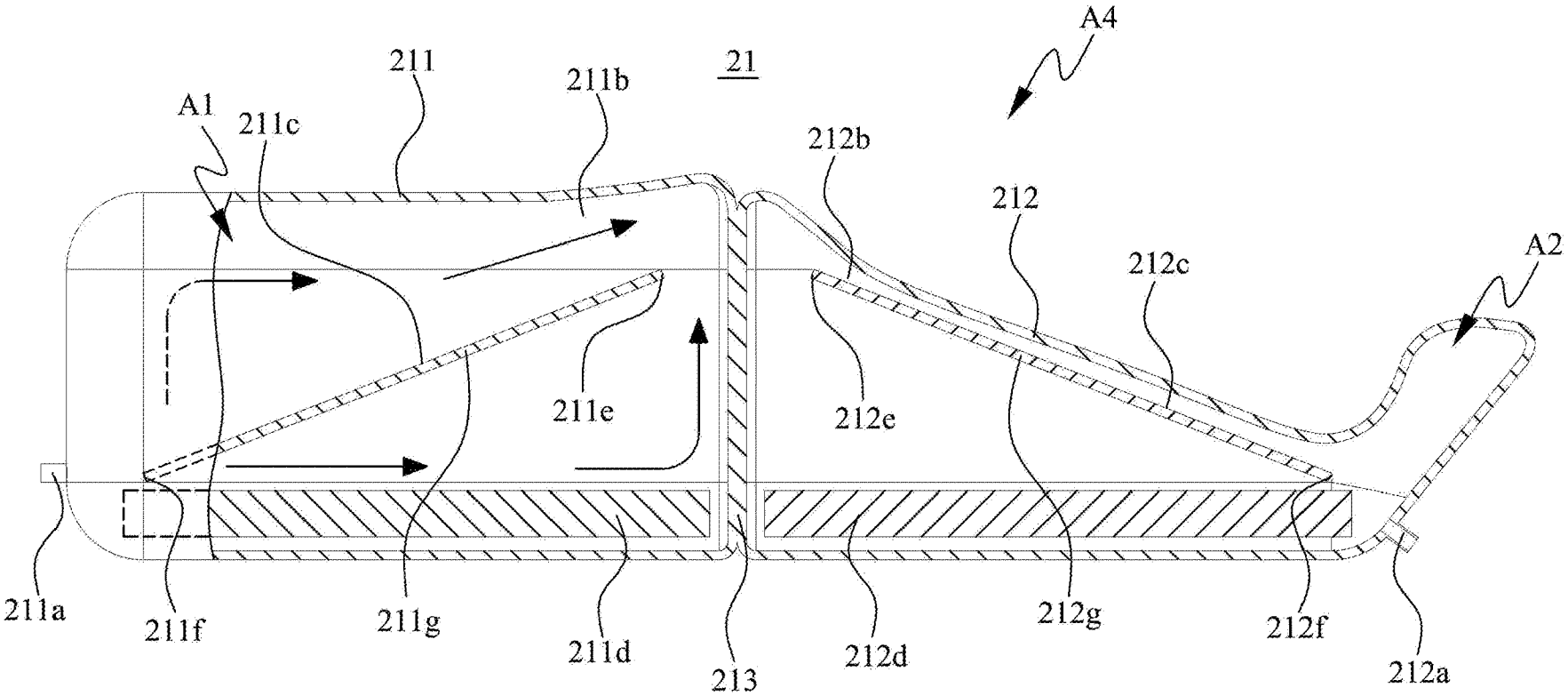
FIG. 12A is a schematic illustrating the first and second right air cells in the deflated state.
Figure 12B:
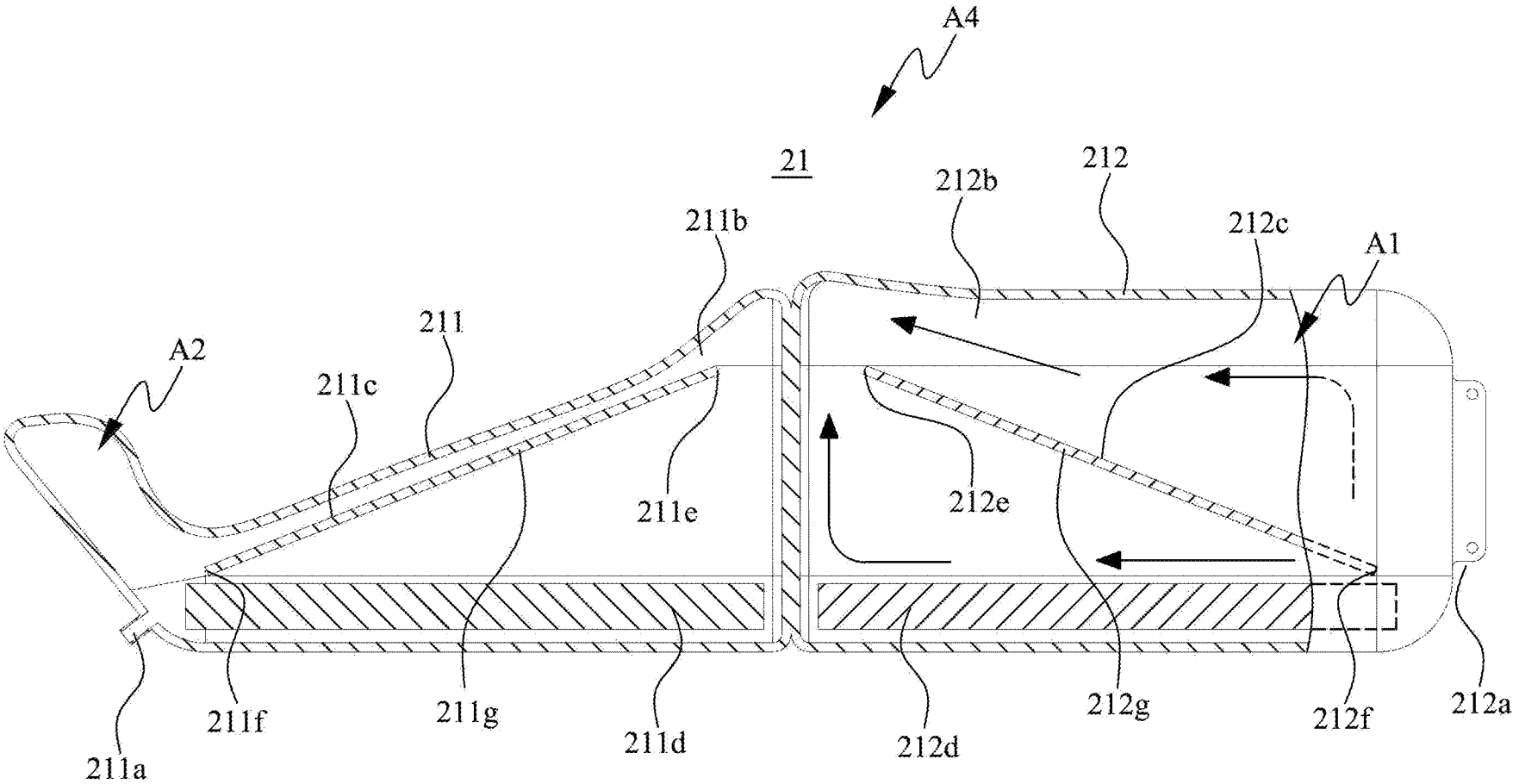
FIG. 12B is a schematic illustrating the first and second left air cells in the deflated state.

Please refer to FIG. 12A. When the patient wants to turn over to the right, the inflating device 30 sucks the gas out of all the first and second right air chambers 212*b*, 222*b*, which makes all the first and second right air chambers 212*b*, 222*b* change from the inflated state A1 to the deflated state A2. At this time, since the first and second left air chambers 211*b*, 211*b* are in the inflated state A1, most of right half of the air cell body 20 is lower than the left half of the airbag body, whereby the air cell body 20 shows a turnover state A4, and further the patient can turn over to the right; when the patient turn over to the right, the patient would be in contact against the first right elastic body 212*d* and the second right elastic body 222*d*, which makes the patient not injured when turning over; however, that the multifunctional mattress overlay 1 of the present invention can assist the patient in turning over to the right is convenient for explanation. Also, as shown in FIG. 12B, when the patient wants to turn over to the left, the inflating device 32 sucks the gas out of all the first and second left air chambers 211*b*, 221*b*, which makes all the first and second left air chambers 211*b*, 221*b* in the deflated state A2, while the first and second right air chambers 212*b*, 222*b* are in the inflated state A1; accordingly, most of the left half of the air cell body 20 is lower than the right half of the air cell body 20, and thus the patient can turn over to the left.

Figure 13:
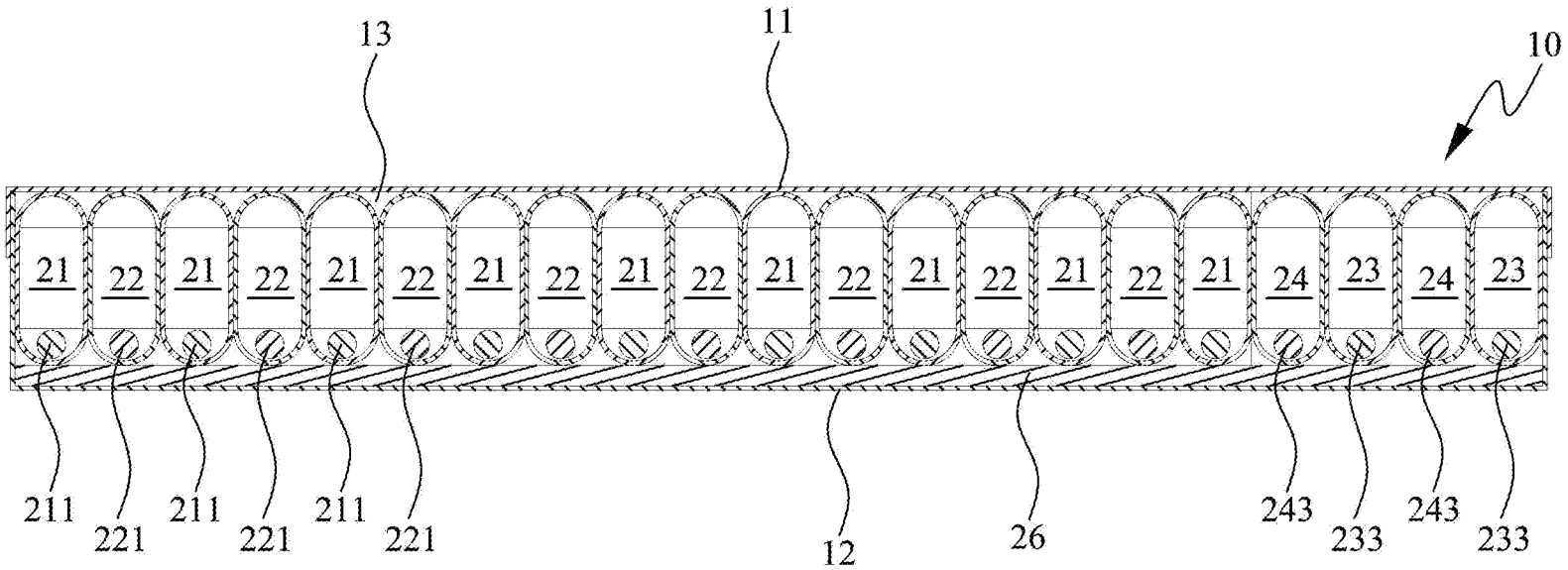
FIG. 13 is a schematic illustrating the multifunctional mattress overlay according to the second embodiment.

Please refer to FIG. 13, in a second preferred embodiment, the difference from the first preferred embodiment is that the air cell body 20 further has an auxiliary elastic body

26 capable of deforming, as shown in the figure, the auxiliary elastic body 26 is inside the accommodation space 13 of the cover body 10, and is located between the lower cover 12 of the cover body 10 and the air cell body 20, such that the auxiliary elastic body 26 is located at the outer bottom of the air cell body 20. In the present embodiment, the auxiliary elastic body 26 is in contact with all the first, second, third and fourth air cells 21, 22, 23, 24, accordingly, when the air cell body 20 is in turnover state to assist the patient in turning over, the patient can touch the auxiliary elastic body 26 to avoid the injury, regardless of whether the patient turns over to the left or right.

What is claimed is:

1. A multifunctional mattress overlay, comprising:

an air cell body comprising a plurality of first air cells arranged laterally, and a plurality of second air cells arranged laterally and alternately to the plurality of first air cells, wherein each of the plurality of first air cells and the second air cells, respectively, have a left air chamber, a partition, and a right air chamber, wherein the partition is arranged between the left air chamber and the right air chamber, and the partition is configured to isolate the left air chamber from the right air chamber;

a gas pipe set comprising a first right gas pipe, a second right gas pipe, a first left gas pipe, and a second left gas pipe, wherein the first right gas pipe is connected to each of the right chambers of the plurality of first air cells, the second right gas pipe is connected to each of the right chambers of the plurality of second air cells, the first left gas pipe is connected to each of the left chambers of the plurality of the first air cells, and the second left gas pipe is connected to each of the left chambers of the plurality of second air cells; and an inflating device connected to the gas pipe set and capable of alternately inflating as well as deflating each of the left and right chambers of the plurality of first air cells or each of the left and right chambers of the plurality of second air cells, which makes the air cell body have an alternate state, and wherein the inflating device can inflate each of the right air chambers or each of the left air chambers separately, which makes the air cell body have a turnover state, wherein an interior of each of the left air chambers and an interior of each of the right air chambers have a deflector therein, wherein each of the deflectors have a head and a tail, the head adjacent to an upper end of the partition and the tail furthest from a lower end of the partition, wherein an incline is formed from the tail to the head, forming a flow guiding portion with respect to the partition, so that the deflector can direct gas to flow toward an upper end of the partition, wherein when the air cell body is in the alternate state, each of the left and right chambers of the plurality of first air cells have an inflated state filled with gas, and simultaneously, each of the left and right chambers of the plurality of second air cells have a deflated state not filled with the gas, and wherein when the air cell body is in the turnover state, each of the left or the right chambers of the plurality of first and second air cells are in an inflated state filled with gas, and simultaneously, each of the other left or the right chambers of the plurality of first and second air cells is in a deflated state not filled with gas.

2. The multifunctional mattress overlay according to claim 1, wherein an inclination direction of the deflector located inside of the left air chamber is different from an inclination direction of the deflector located inside of the right air chamber.

3. The multifunctional mattress overlay according to claim 1, wherein the air cell body further has an elastic body, and the elastic body is adjacent to the lower end of the partition and is inclined with respect to the deflector.

4. The multifunctional mattress overlay according to claim 3, wherein the elastic body is located inside of the left and right air chambers, and an auxiliary elastic body is arranged at an outer bottom of the air cell body, and the auxiliary elastic body is in contact with each of the first and second air cells.

* * * * *